US005651724A

United States Patent [19]

Kimura et al.

[11] Patent Number: 5,651,724

[45] Date of Patent: Jul. 29, 1997

[54] METHOD AND APPARATUS FOR POLISHING WORKPIECE

[75] Inventors: Norio Kimura, Fujisawa; Takayoshi Kawamoto, Chigasaki; You Ishii, Fujisawa; Katsuyuki Aoki, Yokohama; Kunio Tateishi, Fujisawa; Hozumi Yasuda, Fujisawa; Keisuke Namiki, Fujisawa, all of Japan

[73] Assignee: Ebara Corporation, Tokyo, Japan

[21] Appl. No.: 524,824

[22] Filed: Sep. 7, 1995

[30] Foreign Application Priority Data

Sep. 8, 1994 [JP] Japan ..... 6-240642

[51] Int. Cl.[6] ..... B24B 7/00

[52] U.S. Cl. ..... 451/41; 451/285; 451/287; 451/288; 451/398

[58] Field of Search ..... 451/41, 285, 287, 451/288, 289, 397, 398

[56] References Cited

U.S. PATENT DOCUMENTS

| | | | |
|---|---|---|---|
| 4,313,284 | 2/1982 | Walsh | 451/289 |
| 4,899,768 | 2/1990 | Yatabe | 134/66 |
| 4,918,869 | 4/1990 | Kitta | 451/288 |
| 5,081,795 | 1/1992 | Tanaka et al. | 451/288 |
| 5,441,444 | 8/1995 | Nakajima | 451/288 |
| 5,449,316 | 9/1995 | Strasbaugh | 451/289 |

FOREIGN PATENT DOCUMENTS

| | | | |
|---|---|---|---|
| 3052967 | 3/1988 | Japan | 451/288 |
| 6091522 | 4/1994 | Japan | 451/288 |

*Primary Examiner*—Eileen P. Morgan
*Attorney, Agent, or Firm*—Wenderoth, Lind & Ponack

[57] ABSTRACT

A predetermined amount of liquid such as water is supplied to a backside surface of a workpiece such as a semiconductor wafer. Such liquid is a workpiece retaining liquid and is attached to a concave workpiece holding surface of a top ring. The workpiece is positioned between a turntable and the top ring and is polished by an abrasive cloth on the turntable while the workpiece is being pressed against the turntable by the top ring. While polishing, the workpiece is deformed toward the concave workpiece holding surface of the top ring, and a curvature of the deformed workpiece is controlled by the amount of liquid between the workpiece holding surface and the backside surface of the workpiece.

17 Claims, 3 Drawing Sheets

METHOD AND APPARATUS FOR POLISHING WORKPIECE

BACKGROUND OF THE INVENTION

1. Field of the Invention

The present invention relates to a method and apparatus for polishing a workpiece, and more particularly to a method and apparatus for polishing a workpiece such as a semiconductor wafer to a flat mirror finish.

2. Description of the Related Art

Recent rapid progress in semiconductor device integration demands smaller and smaller wiring patterns or interconnections and also narrower spaces between interconnections which connect active areas. One of the processes available for forming such interconnections is photolithography. Though the photolithographic process can form interconnections that are at most 0.5 μm wide, it requires that surfaces on which pattern images are to be focused by a stepper be as flat as possible because the depth of focus of the optical system is relatively small.

It is therefore necessary to make the surfaces of semiconductor wafers flat for photolithography. One customary way of flattening the surfaces of semiconductor wafers is to polish them with a polishing apparatus.

Such a polishing apparatus has a turntable and a top ring which rotate at respective individual speeds. An abrasive cloth is attached to the upper surface of the turntable. A workpiece such as a semiconductor wafer to be polished is placed on the abrasive cloth and clamped between the top ring and the turntable. During a polishing operation, the top ring exerts a constant pressure on the turntable, and an abrasive slurry is supplied from a nozzle over the abrasive cloth. The abrasive slurry is interposed between the abrasive cloth and the semiconductor wafer. The lower (front) surface of the semiconductor wafer held against the abrasive cloth is therefore polished while the top ring and the turntable are rotating.

In the conventional polishing apparatus, the top ring has a wafer holding surface, which is flat, for holding the semiconductor wafer at a lower surface thereof. In this polishing apparatus, a polishing rate is influenced by the relative velocity of the abrasive cloth and the semiconductor wafer, a pressing force applied to the semiconductor wafer, the amount of the abrasive slurry on the abrasive cloth, and working time of the abrasive cloth. That is, a uniform polished surface is obtainable by equalizing the above factors over the entire surface of the semiconductor wafer to be polished. Of the above factors which affect the polishing rate, the relative velocity of the surface of the semiconductor wafer to be polished and the abrasive cloth can theoretically equalize over the entire surface of the semiconductor wafer by rotating the turntable and the top ring at the same rotational speed and in the same direction.

Further, as means for making uniform a pressing force over the entire surface of the semiconductor wafer, the top ring made of hard material such as ceramics is known. Further, the polishing apparatus disclosed in Japanese laid-open patent publication No. 6-91522 has a top ring on which a diaphragm is provided to uniformize a pressing force over the entire surface of the semiconductor wafer by applying a fluid pressure to the diaphragm. The polishing apparatus disclosed in U.S. Pat. No. 4,373,991 has a top ring which has passages at the lower surface thereof to supply a fluid pressure therethrough to the semiconductor wafer.

However, in the conventional polishing methods and apparatuses, since a liquid-like abrasive slurry is supplied onto the abrasive cloth on the rotating turntable, the abrasive slurry tends to move radially outwardly by a centrifugal force. Therefore, it is difficult to uniformize the amount of the abrasive slurry over the entire surface of the abrasive cloth. In addition to nonuniformity of the amount of the abrasive slurry on the abrasive cloth, the polished surface of the semiconductor wafer is affected by the sizes of abrasive grains in the abrasive slurry and the property of solution which dilutes the abrasive grains. The polished surface of the semiconductor wafer has the tendency of representing causes of nonuniformity of the polished surface by itself.

In case of using an abrasive slurry comprising abrasive grains containing silica such as $SiO_2$ in an alkaline solution, the polishing action is performed in such a manner that the surface of the semiconductor wafer to be polished contacts the alkaline solution and the surface etched with the alkaline solution is ground off by the abrasive grains. In this case, the surface of the semiconductor wafer tends to be over-polished at the outer peripheral portion thereof.

In case of using an abrasive slurry comprising abrasive grains containing cerium such as $CeO_2$ in an aqueous solution, the polishing action is performed only by mechanical polishing because diameters of the abrasive grains containing cerium are larger than those of the abrasive grains containing silica and the aqueous solution does not have an etching action. In this case, the surface of the semiconductor wafer tends to be over-polished at the central portion thereof. The above phenomena are not desirable in the polishing apparatus which is used for polishing the semiconductor wafer to a flat mirror finish.

SUMMARY OF THE INVENTION

It is therefore an object of the present invention to provide a method and apparatus for polishing a workpiece such as a semiconductor wafer and which can uniformly polish a surface of the workpiece, and, irrespective of nonuniformity of distribution of an abrasive slurry and nonuniformity of chemical mechanical polishing action.

According to one aspect of the present invention, there is provided a polishing method for polishing a surface of a workpiece comprising the steps of supplying a predetermined amount of workpiece retaining liquid to a backside surface of a workpiece, attaching the workpiece retaining liquid to a top ring which has a workpiece holding surface, the workpiece holding surface being a concave surface, and pressing the workpiece against an abrasive cloth mounted on a turntable by the top ring, thus polishing the workpiece.

According to another aspect of the present invention, there is provided a polishing apparatus for polishing a surface of a workpiece comprising a turntable with an abrasive cloth mounted on an upper surface thereof, a top ring positioned above the turntable for holding the workpiece to be polished and pressing the workpiece against the abrasive cloth, means for pressing the workpiece held by the top ring against the abrasive cloth, a workpiece holding surface provided on the top ring for holding the workpiece, the workpiece holding surface being a concave surface, and means for supplying a predetermined amount of liquid to a backside surface of the workpiece before the workpiece is attached to the top ring.

According to the present invention, the top ring has a workpiece holding surface which is a concave surface, the workpiece is held by the concave surface, and the polishing operation is carried out. After a predetermined amount of liquid such as water is supplied to the backside surface of the workpiece, the workpiece is attached to the concave surface of the top ring. Thereafter, the semiconductor wafer is pressed against the abrasive cloth to thus perform a polishing operation. In a preferred embodiment, pressurized gas such as compressed air is supplied to a space between the backside surface of the semiconductor wafer and the concave surface of the top ring during polishing.

Before supplying a predetermined amount of liquid such as water to the backside surface of the workpiece, the workpiece holding surface of the top ring and the backside surface of the workpiece are washed, and dried. Thereafter, the predetermined amount of liquid is supplied to the backside surface of the workpiece. Since the space is defined between the backside surface of the workpiece and the workpiece holding surface of the top ring and liquid is interposed between the backside surface of the workpiece and the workpiece holding surface of the top ring, the workpiece can be polished in such a manner that the workpiece is not influenced directly by the shape of the workpiece holding surface of the top ring. During polishing, the outer peripheral portion of the workpiece contacts the workpiece holding surface of the top ring, and there exists liquid in the space defined between the backside surface of the workpiece and the workpiece holding surface of the top ring. Thus, a pressing force of the central portion of the workpiece can be adjusted freely with respect to the pressing force of the outer peripheral portion of the workpiece.

Further, by supplying pressurized gas to the space in addition to the liquid, the pressing force of the central portion of the workpiece can be adjusted more precisely with respect to the pressing force of the outer peripheral portion of the workpiece.

The above and other objects, features, and advantages of the present invention will become apparent from the following description of illustrative embodiments thereof in conjunction with the accompanying drawings.

DETAILED DESCRIPTION OF THE PREFERRED EMBODIMENTS

Figure 1:
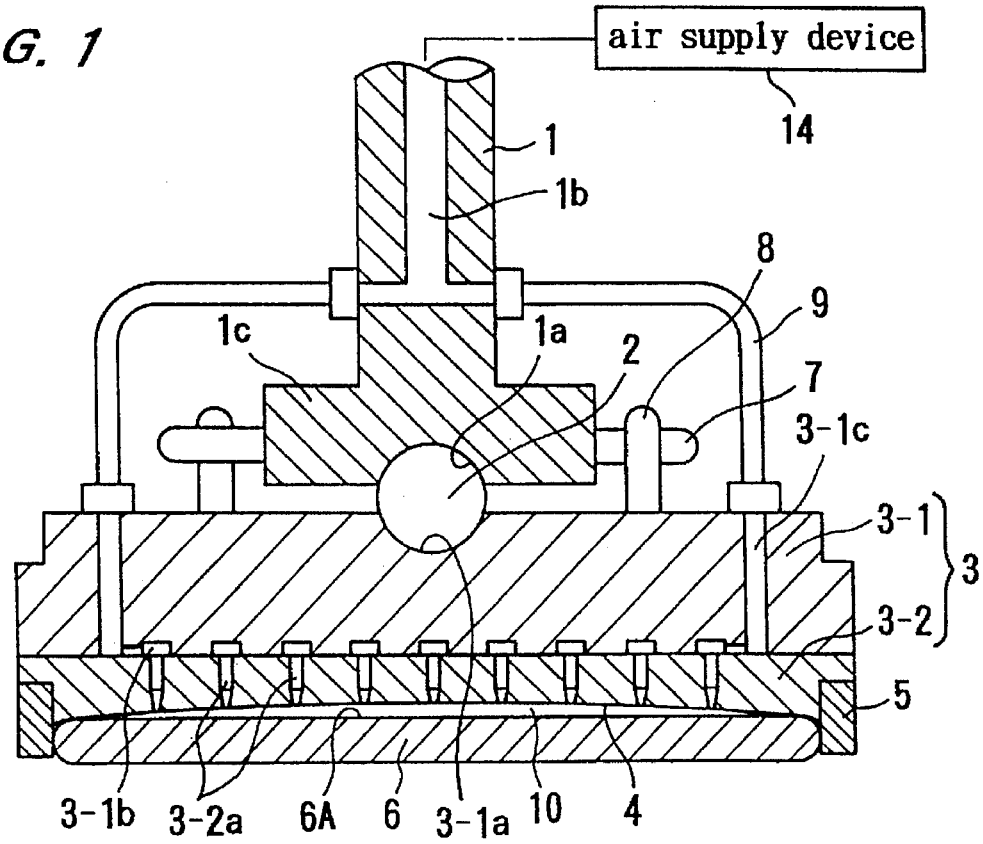
FIG. 1 is a sectional side view of a polishing unit of a polishing apparatus according to a first embodiment of the present invention.

As shown in FIG. 1, a polishing unit of a polishing apparatus according to the present invention comprises a vertical top ring drive shaft 1, a top ring 3 and a spherical bearing 2 interposed between the top ring drive shaft 1 and the top ring 3. The top ring drive shaft 1 has a central spherical concave surface 1*a* formed in a lower end thereof and held in sliding contact with the spherical bearing 2. The top ring 3 comprises an upper top ring member 3-1 and a lower top ring member 3-2 fixed to the lower surface of the upper top ring member 3-1. The upper top ring member 3-1 has a central spherical concave surface 3-1*a* formed in an upper surface thereof and held in sliding contact with the spherical bearing 2. A wafer guide ring 5 is mounted on a lower surface of the lower top ring member 3-2 along its outer circumferential edge.

The lower top ring member 3-2 has a plurality of vertical holes 3-2*a* formed therein. The vertical holes 3-2*a* are open at the lower surface of the lower top ring member 3-2. The upper top ring member 3-1 has a plurality of grooves 3-1*b* formed therein and communicating with the holes 3-2*a*, respectively, and a plurality of holes 3-1*c* formed therein and communicating with the suction grooves 3-1*b*. The holes 3-1*c* are connected through flexible tubes 9 to a central hole 1*b* formed axially centrally in the top ring drive shaft 1.

The top ring drive shaft 1 has a radially outwardly extending flange 1*c* on its lower end from which a plurality of torque transmission pins 7 extend radially outwardly. The upper surface of the upper top ring member 3-1 has a plurality of torque transmission pins 8 projecting upwardly for point contact with the torque transmission pins 7, respectively.

The lower top ring member 3-2 of the top ring 3 has a wafer holding surface 4, at a lower surface thereof, which is a concave surface. The depth from the outer periphery of the concave surface to the bottom of the concave surface is approximately 12 μm. A semiconductor wafer 6 to be polished is held in a space defined between the wafer holding surface 4 and the inner circumferential edge of the wafer guide ring 5. In case of polishing a semiconductor wafer having a diameter of 6 inches, the depth of the concave surface is preferably in the range of 1 to 50 μm. When the semiconductor wafer 6 is held by the wafer holding surface 4 and the wafer guide ring 5, the lower (front) surface of the semiconductor wafer 6 projects slightly from the lower end of the wafer guide ring 5. The wafer guide ring 5 serves to prevent the semiconductor wafer 6 from being disengaged from the wafer holding surface 4.

Since the semiconductor wafer 6 has a flat backside surface 6A, when the semiconductor wafer 6 is held by the wafer holding surface 4 of the top ring 3, a space 10 is defined between the backside surface 6A of the semiconductor wafer 6 and the wafer holding surface 4 of the top ring 3. That is, since only the outer peripheral portion of the semiconductor wafer 6 contacts the wafer holding surface 4 of the top ring 3, a certain clearance is formed between the central portion of the semiconductor wafer 6 and the wafer holding surface 4 of the top ring 3. Thus, the central portion of the semiconductor wafer 6 can be deformed toward the wafer holding surface 4 by elastic deformation.

Figure 2:
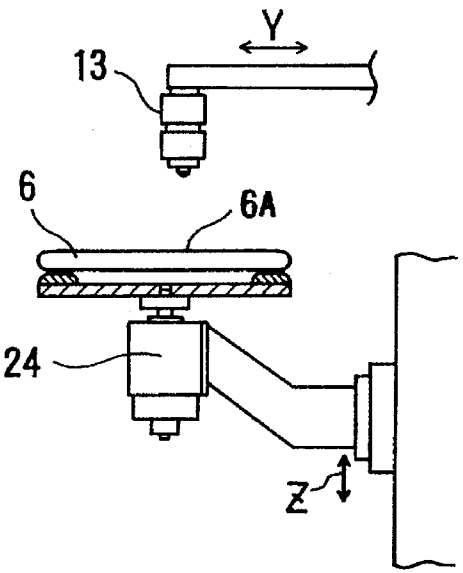
FIG. 2 is a sectional side view of the polishing unit incorporating the polishing apparatus of FIG. 1 according to an embodiment of the present invention.
Figure 2:
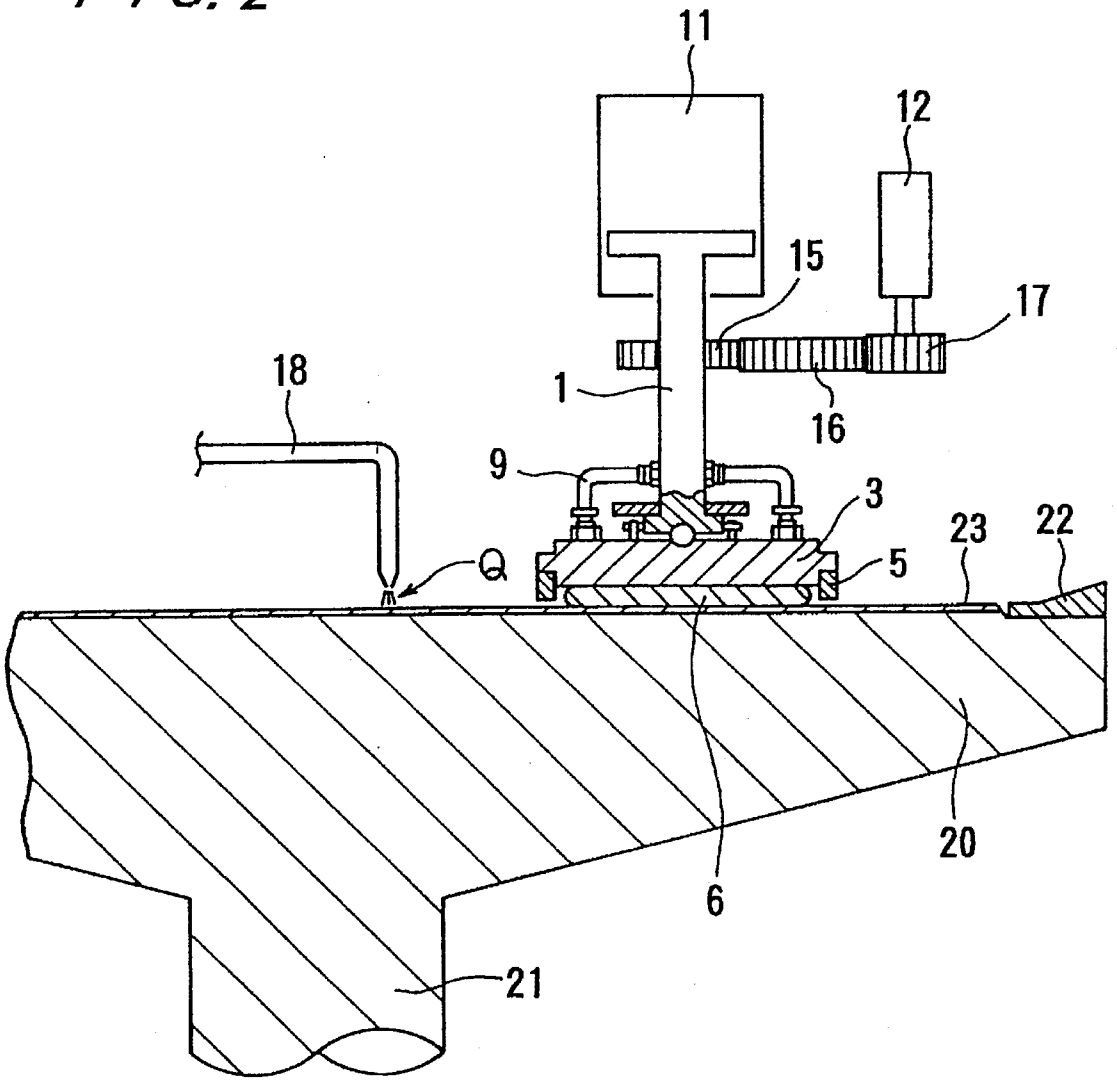

FIG. 2 shows the polishing apparatus which incorporates the polishing unit shown in FIG. 1. As shown in FIG. 2, a turntable 20 is supported on a central shaft 21 and is rotatable about the axis of the shaft 21. A turntable ring 22 for preventing an abrasive slurry from being scattered around is mounted on the upper surface of the turntable 20 along its outer circumferential edge. An abrasive cloth 23 is attached to the upper surface of the turntable 20 radially inwardly of the turntable ring 22.

The polishing unit shown in FIG. 1 is located above the turntable 20. The top ring 3 is pressed against the turntable 20 under a constant pressure by a top ring cylinder 11 which houses a slidable piston that is connected to the upper end of the top ring drive shaft 1. The polishing apparatus also has a top ring motor 12 for rotating the top ring drive shaft 1 through a transmission mechanism comprising a gear 15 fixed to the top ring drive shaft 1, a gear 17 coupled to the output shaft of the top ring motor 12, and a gear 16 meshingly engaged with the gears 15, 17. An abrasive slurry nozzle 18 is disposed above the turntable 20 for supplying an abrasive slurry Q onto the abrasive cloth 23 on the turntable 20.

The polishing apparatus of the present invention has a pusher 24 which is provided adjacent to the turntable 20 and serves to transfer the semiconductor wafer 6 to the top ring 3. The pusher 24 is vertically movable as shown by an arrow Z. Above the pusher 24, a water supply device 13 is provided to supply drops of water to the backside surface 6A of the semiconductor wafer 6 on the pusher 24. The water supply device 13 is horizontally movable as shown by an arrow Y and can control the amount of water to be supplied to the semiconductor wafer 6.

With the above arrangement, the semiconductor wafer 6 having a lower surface to be polished is placed on the pusher 24 by a transfer robot or the like. The water supply device 13 moves forward and is positioned above the semiconductor wafer 6. Thereafter, the water supply device 13 supplies a predetermined amount of water to the backside surface 6A of the semiconductor wafer 6. After the water supply device 13 moves backward and is away from the semiconductor wafer 6, the top ring 3 moves toward the semiconductor wafer 6 and is positioned above the semiconductor wafer by a moving mechanism. Thereafter, the semiconductor wafer 6 is held by the top ring 6 by pressing the semiconductor wafer 6 against the holding surface 4 of the top ring 3 by the pusher 24.

As shown in FIG. 1, the polishing apparatus of the present invention has an air supply device 14 which is connected to the hole 1*b* of the top ring drive shaft 1. The air supply device 14 supplies air to the space 10 between the backside surface 6A of the semiconductor wafer 6 and the wafer holding surface 4 of the top ring 3, through the hole 1*b*, the flexible tubes 9, the grooves 3-1*b* and the holes 3-2*a*. The air supply device 14 is provided with a regulator for regulating the pressure of air which is supplied to the space 10.

The polishing apparatus in FIGS. 1 and 2 operates as follows: After a predetermined amount of water is supplied to the backside surface 6A of the semiconductor wafer 6, the semiconductor wafer 6 is held by the wafer holding surface 4 of the top ring 3, and pressed against the abrasive cloth 23 on the turntable 20 by the top ring cylinder 11. The turntable 20 is rotated by the shaft 21, and the top ring 3 is rotated by the top ring motor 12. The turntable 20 and the top ring 3 are rotated at the same rotational speed and in the same direction. Further, the abrasive liquid Q is supplied from the abrasive slurry nozzle 18 onto the abrasive cloth 23. The abrasive slurry Q is retained by the abrasive cloth 23, and applied to the lower surface of the semiconductor wafer 6. The semiconductor wafer 6 is polished in contact with the abrasive slurry Q on the abrasive cloth 23.

Simultaneously with the above operation, pressurized air is supplied to the space 10 from the air supply device 14 through the hole 1*b*, the flexible tubes 9, the grooves 3-1*b* and the holes 3-2*a*, thereby pushing the backside surface 6A of the semiconductor wafer 6. It is desirable that the pressing force of the top ring drive shaft 1 is substantially equal to or greater than the pressure of the air supplied to the space 10.

When dust particles are interposed between the backside surface 6A of the semiconductor wafer 6 and the wafer holding surface 4 of the top ring 3, small convex surfaces are formed on the semiconductor wafer 6. The convex surfaces on the semiconductor wafer 6 tend to be over-polished, thus forming a plurality of thin spots or so-called bull's eye. In order to avoid formation of such bull's eye, dust particles are removed by washing the wafer holding surface 4 of the top ring 3 and the backside surface 6A of the semiconductor wafer by a washing device and a drying device incorporated in the polishing apparatus. That is, before loading the semiconductor wafer 6 onto the top ring 3, the wafer holding surface 4 of the top ring 3 and the backside surface 6A of the semiconductor wafer are washed and dried by the washing device and the drying device. A washing process is carried out by spraying pure water (deionized water) or scrubbing with a brush or a sponge brush. A drying process is carried out by blowing high purity $N_2$ gas or clean air, or irradiating infrared rays. By this washing and drying processes, a predetermined amount of water can be accurately supplied to the backside surface 6A of the semiconductor wafer 6 before a polishing operation thereof.

With the above structure of the polishing apparatus, the following polishing action is obtainable. Actually, the depth of the concave surface is in the range of 1 to 50 μm which is extremely shallow, and it is difficult to observe behavior of the semiconductor wafer during a polishing operation. Therefore, the polishing action which will be described below was evaluated from experimental results.

Since the wafer holding surface 4 of the top ring 3 is a concave surface and holds the semiconductor wafer 6 having the flat backside surface 6A, only the outer peripheral portion of the semiconductor wafer 6 contacts the wafer holding surface 4 of the top ring 3, and the space 10 is defined between the central portion of the semiconductor wafer 6 and the wafer holding surface 4 of the top ring 3. Therefore, the central portion of the semiconductor wafer 6 can be deformed toward the wafer holding surface 4 within elastic deformation limits of the wafer.

During polishing, the lower surface of the semiconductor wafer 6 is pushed from the abrasive cloth 23 having an elastic property. At this time, the outer peripheral portion of the semiconductor wafer 6 is rigidly supported by the wafer holding surface 4 of the top ring 3, but the central portion of the semiconductor wafer 6 is deformed toward the wafer holding surface 4 because the central portion of the semiconductor wafer 6 is not supported. When the semiconductor wafer 6 is deformed, a curvature of the deformed semiconductor wafer 6 varies in accordance with the amount of water which has been supplied to the backside surface 6A of the semiconductor wafer 6. Further, the backside surface 6A of the semiconductor wafer 6 is attached to the wafer holding surface 4 by a surface tension of water between the backside surface 6A of the semiconductor wafer 6 and the wafer holding surface 4. As a result, a curvature of the semiconductor wafer 6 varies in accordance with the amount of water interposed between the central portion of the semiconductor wafer 6 and the wafer holding surface 4 of the top ring 3.

Therefore, when the semiconductor wafer 6 is polished, the curvature of the semiconductor wafer 6 can be controlled in accordance with the amount of water which has been supplied to the backside surface 6A of the semiconductor wafer 6, and the difference of the polishing action between the central portion and the outer peripheral portion of the semiconductor wafer 6 can be compensated by controlling the curvature of the semiconductor wafer 6, thus improving uniformity of polishing action over the entire surface of the semiconductor wafer.

Further, by supplying pressurized air to the space 10 through the hole 1*b*, the grooves 3-1*b* and the holes 3-2*a*, the central portion of the backside surface 6A of the semiconductor wafer 6 is pushed toward the abrasive cloth 23. Therefore, the curvature of the semiconductor wafer 6 can be controlled not only by controlling the amount of water, but also by controlling the pressure of the air in the space 10. Since it is possible to change the pressure of the air in the space 10 during polishing, the curvature of the semiconductor wafer 6 can be controlled during polishing.

Figure 3:
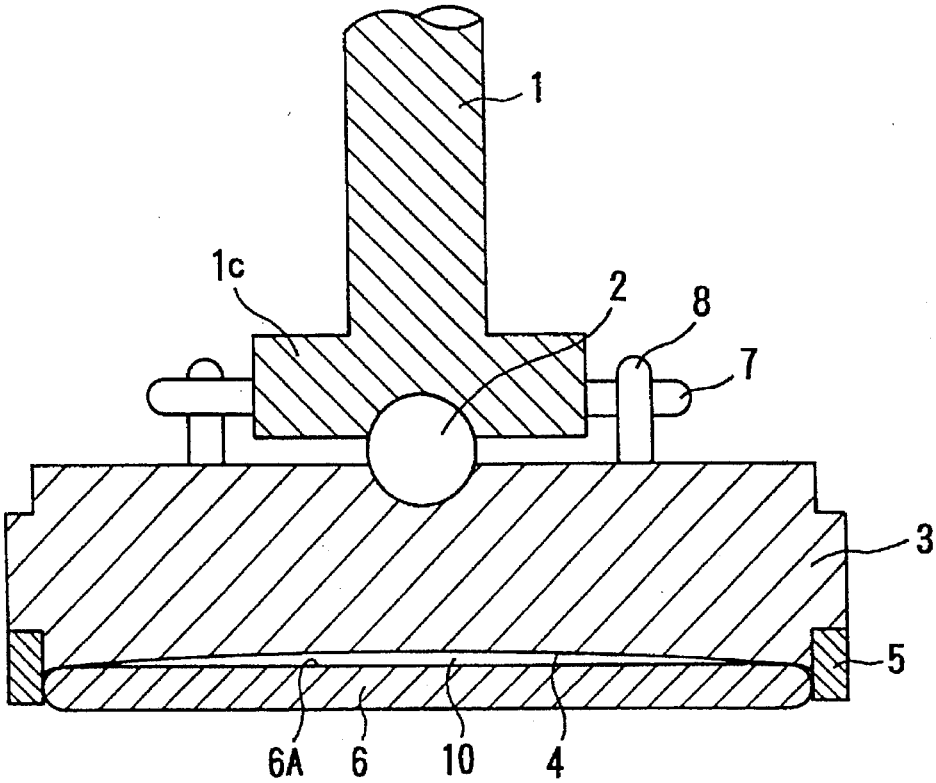
FIG. 3 is a sectional side view of a polishing unit of a polishing apparatus according to a second embodiment of the present invention.

FIG. 3 shows a polishing unit of a polishing apparatus according to a second embodiment of the present invention. As shown in FIG. 3, the polishing unit has a top ring 3 which is devoid of any holes and grooves, and a top ring drive shaft 1 that has no axial hole. The top ring 3 has a wafer holding surface 4 which is a concave surface as in the first embodiment of FIG. 1. The polishing unit of this embodiment is not provided with an air supply device.

With the above structure, after drops of water are supplied to the backside surface 6A of the semiconductor wafer 6 by the water supply device 13 (see FIG. 2), the semiconductor wafer 6 is attached to the wafer holding surface 4 of the top ring 3, and then the polishing operation is started. Action of water interposed between the backside surface 6A of the semiconductor wafer 6 and the wafer holding surface 4 of the top ring 3 is the same as the first embodiment of FIG. 1. According to the polishing apparatus of this embodiment, it is not necessary to provide grooves and holes in the top ring and an air supply device, therefore the structure of the polishing apparatus becomes simple.

Figure 4:
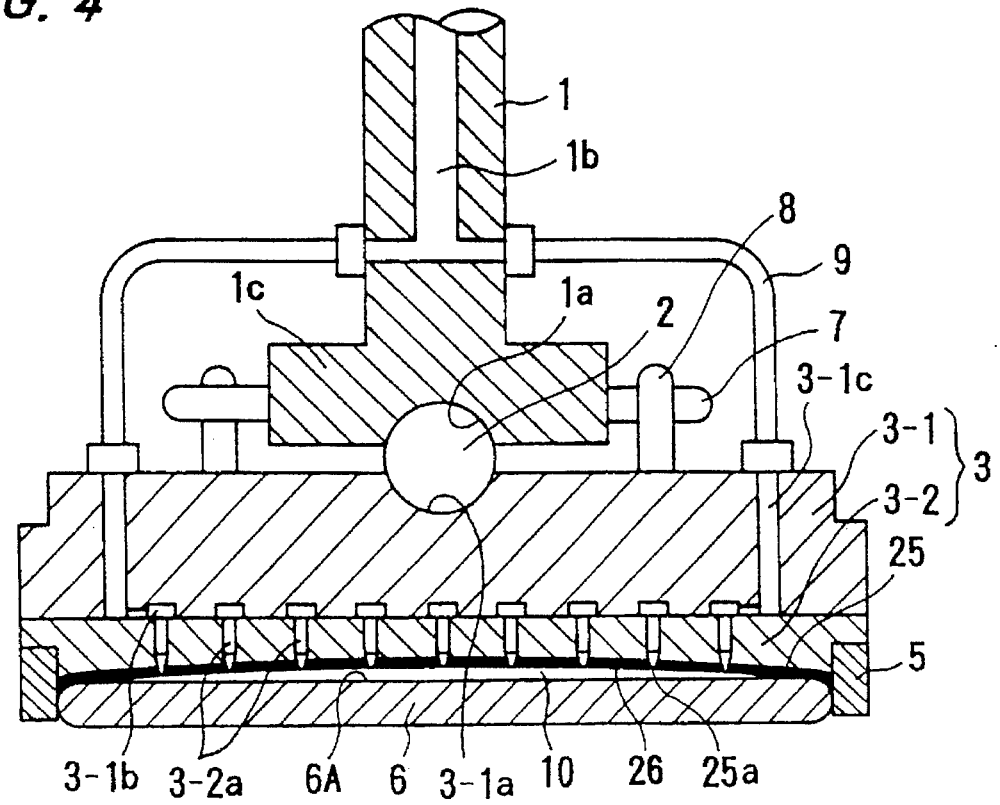
FIG. 4 is a sectional side view of a polishing unit of a polishing apparatus according to a third embodiment of the present invention.

FIG. 4 shows a polishing unit of a polishing apparatus according to a third embodiment of the present invention. As shown in FIG. 4, the polishing unit has a top ring 3 which has a concave lower surface. A backing pad 25 made of elastic material such as synthetic resin is attached to the concave lower surface of the top ring 3. Since the backing pad 25 has a constant thickness, the top ring 3 has a wafer holding surface 26 which is defined by a concave lower surface of the backing pad 25. The depth of the outer periphery to the bottom of the wafer holding surface 26 is the same as that of the wafer holding surface 4 in the first embodiment of FIG. 1. The backing pad 25 has a plurality of holes 25*a* formed therein and communicating with the holes 3-2*a*, respectively. The semiconductor wafer 6 to be polished is held in a space 10 defined between the wafer holding surface 26 and the inner circumferential edge of the wafer guide ring 5. The other details of the polishing unit shown in FIG. 4 are identical to those of the polishing unit shown in FIG. 1.

According to the third embodiment, since the backing pad 25 is provided on the lower surface of the top ring 3, the amount of water which is retained on the top ring increases, and the water which contacts the backside surface 6A of the semiconductor wafer 6 can be uniformly distributed. Further, by using the backing pad 25 made of elastic material, the sealing effect between the outer peripheral portion of the semiconductor wafer 6 and the wafer holding surface 26 of the backing pad 25 is enhanced.

Figure 5:
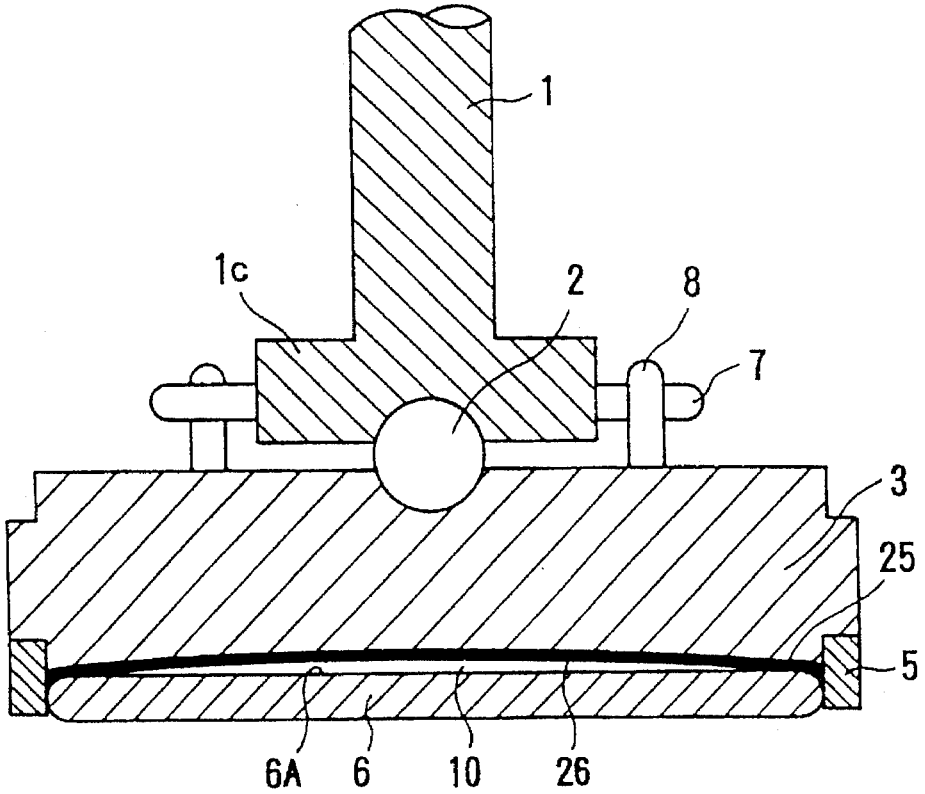
FIG. 5 is a sectional side view of a polishing unit of a polishing apparatus according to a fourth embodiment of the present invention.

FIG. 5 shows a polishing unit of a polishing apparatus according to a fourth embodiment of the present invention. As shown in FIG. 5, the polishing unit has a top ring 3 which is devoid of any holes and grooves, and a top ring drive shaft 1 that has no axial suction hole, as in the second embodiment of FIG. 3. The top ring 3 has a concave lower surface. A backing pad 25 made of elastic material such as synthetic resins is attached to the concave lower surface of the top ring 3. Since the backing pad 25 has a constant thickness, the top ring 3 has a wafer holding surface 26 which is defined by a concave lower surface of the backing pad 25. The depth of the outer periphery to the bottom of the wafer holding surface 26 is the same as that of the wafer holding surface 4 of the top ring 3 in the first embodiment of FIG. 1. The semiconductor wafer 6 to be polished is held in a space 10 defined between the wafer holding surface 26 and the inner circumferential edge of the wafer guide ring 5. The other details of the polishing unit shown in FIG. 5 are identical to those of the polishing unit shown in FIG. 3.

In the first and third embodiments of FIGS. 1 and 3, pressurized air is supplied to the space 10 between the wafer holding surface 4 or 26 of the top ring 3 and the backside surface 6A of the semiconductor wafer 6. However, instead of air, $N_2$ gas or any other gas may be used in the first and third embodiments. Moreover, instead of gas, liquid may be used as a fluid.

Further, in the first through forth embodiments, the concave surface of the top ring 3 does not mean only a semispherical surface, but includes any surface having a circular outer peripheral portion and a recessed central portion. The depth of the concave surface may be selected in accordance with the size of the semiconductor wafer or material of the semiconductor wafer.

Although water is supplied to the backside surface 6A of the semiconductor wafer 6 in the above embodiments, any other liquid may be used. Further, workpieces that can be polished by the polishing apparatus according to the present invention are not limited to semiconductor wafers, but may be various other workpieces.

In the above embodiments, in order to save working time per workpiece, the polishing method may dispense with at least one of the washing process and the drying process.

As is apparent from the foregoing description, the polishing apparatus of the present invention offers the following advantages:

(1) Inasmuch as the central portion of the semiconductor wafer can be deformed within elastic deformation limits of the wafer during polishing, the difference of the polishing action between the central portion and the outer peripheral portion of the semiconductor wafer can be compensated by the curvature of the semiconductor wafer, thus improving uniformity of polishing action over the entire surface of the semiconductor wafer. As a result, the flatness of the semiconductor wafer is improved.

(2) By controlling the amount of water which is supplied to the backside surface of the semiconductor wafer, and supplying a constant amount of water at all times, the reproducibility of flatness of the semiconductor wafer is obtainable.

(3) By supplying pressurized air to the backside surface of the semiconductor wafer to push the central portion of the semiconductor wafer toward the abrasive cloth, the curvature of the semiconductor wafer can be controlled during polishing.

Although certain preferred embodiments of the present invention have been shown and described in detail, it should be understood that various changes and modifications may be made therein without departing from the scope of the appended claims.

What is claimed is:

1. A polishing method for polishing a surface of a workpiece, said method comprising the steps of:

supplying liquid to a backside surface of a workpiece;

attaching said workpiece to a top ring which has a concave workpiece holding surface, with said liquid being between said workpiece holding surface and said backside surface of said workpiece;

pressing said workpiece against an abrasive cloth mounted on a turntable by said top ring and polishing said workpiece; and providing said liquid in an amount to ensure, upon said pressing, application to a central portion of said workpiece of a pressing force that is controlled with respect to a pressing force applied to an outer peripheral portion of said workpiece.

2. The method for polishing a surface of a workpiece according to claim 1, wherein said workpiece holding surface is formed on a lower surface of said top ring.

3. The method for polishing a surface of a workpiece according to claim 1, wherein said top ring is provided with a backing pad and said workpiece holding surface is formed on a lower surface of said backing pad.

4. The method for polishing a surface of a workpiece according to claim 1, further comprising at least one of the steps of:

washing said backside surface of said workpiece and said workpiece holding surface of said top ring before supplying said liquid to said backside surface of said workpiece; and drying said backside surface of said workpiece and said workpiece holding surface of said top ring.

5. The method for polishing a surface of workpiece according to claim 1, further comprising supplying pressurized fluid to a space defined between said backside surface of said workpiece and said workpiece holding surface of said top ring during polishing.

6. The method for polishing a surface of workpiece according to claim 5, wherein said fluid comprises gas.

7. The method for polishing a surface of workpiece according to claim 1, comprising applying said pressing force to said outer peripheral portion of said workpiece by direct contact therewith by an outer peripheral portion of said workpiece holding surface, maintaining said liquid in a space between said central portion of said workpiece and a central portion of said workpiece holding surface, and applying said pressing force to said central portion of said workpiece through said liquid in said space.

8. An apparatus for polishing a surface of a workpiece, said apparatus comprising:

a turntable with an abrasive cloth mounted on an upper surface thereof;

a top ring positioned above said turntable for holding a workpiece to be polished and pressing the workpiece against said abrasive cloth;

means for pressing the workpiece held by said top ring against said abrasive cloth;

said top ring having a concave workpiece holding surface for holding the workpiece; and means for supplying to a backside surface of the workpiece before the workpiece is attached to said top ring an amount of liquid to ensure, upon operation of said pressing means, application to a central portion of the workpiece of a pressing force that is controlled with respect to a pressing force applied to an outer peripheral portion of the workpiece.

9. The apparatus for polishing a surface of a workpiece according to claim 8, wherein said workpiece holding surface is formed on a lower surface of said top ring.

10. The apparatus for polishing a surface of a workpiece according to claim 8, wherein said top ring is provided with a backing pad and said workpiece holding surface is formed on a lower surface of said backing pad.

11. The apparatus for polishing a surface of a workpiece according to claim 8, further comprising holes formed in said top ring for supplying fluid to the backside surface of the workpiece during polishing.

12. The apparatus for polishing a surface of a workpiece according to claim 11, wherein said fluid comprises gas.

13. The apparatus for polishing a surface of a workpiece according to claim 11, further comprising a fluid supply device for supplying fluid to said holes to apply said fluid under pressure to the backside surface of the workpiece during polishing.

14. The apparatus for polishing a surface of a workpiece according to claim 13, wherein said fluid comprises gas.

15. The apparatus for polishing a surface of a workpiece according to claim 8, further comprising at least one of:

a washing device for washing the backside of the workpiece and said workpiece holding surface of said top ring before supplying liquid to the backside of the workpiece; and a drying device for drying the backside of the workpiece and said workpiece holding surface of said top ring.

16. The apparatus for polishing a surface of a workpiece according to claim 4, wherein said concave workpiece holding surface is configured such that, upon operation of said pressing means, an outer peripheral portion of said workpiece holding surface directly contacts the outer peripheral portion of the workpiece and applies said pressing force thereto, and a central portion of said workpiece holding surface is spaced from the central portion of the workpiece with the liquid therebetween, whereby said pressing force applied to the central portion of the workpiece is applied thereto through the liquid.

17. The apparatus for polishing a surface of a workpiece according to claim 8, wherein said top ring comprises a rigid and non-deformable member.

* * * * *

UNITED STATES PATENT AND TRADEMARK OFFICE

CERTIFICATE OF CORRECTION

PATENT NO. : 5,651,724

DATED : July 29, 1997

INVENTOR(S) : Norio KIMURA et al.

It is certified that error appears in the above-indentified patent and that said Letters Patent is hereby corrected as shown below:

Claim 16, line 2, change "claim 4" to --claim 8--.

Signed and Sealed this

Twenty-fifth Day of November, 1997

*Attest:*

*Attesting Officer*

BRUCE LEHMAN

*Commissioner of Patents and Trademarks*